United States Patent [19]

Dyson

[11] Patent Number: 4,593,429

[45] Date of Patent: Jun. 10, 1986

[54] VACUUM CLEANING APPLIANCE

[75] Inventor: James Dyson, Bath, England

[73] Assignee: Prototypes, Ltd., Bath, England

[21] Appl. No.: 640,758

[22] Filed: Aug. 14, 1984

Related U.S. Application Data

[63] Continuation of Ser. No. 452,917, Dec. 27, 1982, abandoned, which is a continuation of Ser. No. 274,252, Jun. 16, 1981, abandoned.

[30] Foreign Application Priority Data

| | | | |
|---|---|---|---|
| Jun. 19, 1980 | [GB] | United Kingdom | 8020041 |
| Aug. 8, 1980 | [GB] | United Kingdom | 8025960 |
| Sep. 25, 1980 | [GB] | United Kingdom | 8030964 |

[51] Int. Cl.[4] ..... A47L 5/30; B01D 45/12

[52] U.S. Cl. ..... 15/353; 15/335; 55/345; 55/357; 55/429; 55/439; 55/459 R; 55/472; 55/DIG. 3

[58] Field of Search ..... 15/331, 334, 335, 353; 55/345, 357, 429, 439, 472, 436, 459 R, DIG. 3; 209/144; 210/512.1, 512.2

[56] References Cited

U.S. PATENT DOCUMENTS

| | | | |
|---|---|---|---|
| 420,072 | 1/1890 | Johnson | 55/345 |
| 1,953,944 | 4/1934 | Becker | 15/335 |
| 2,171,248 | 8/1939 | Van Berkel | 55/472 X |
| 2,176,467 | 10/1939 | Milner, Jr. et al. | 15/331 X |
| 2,252,581 | 8/1941 | Saint-Jacques . | |
| 2,347,731 | 5/1944 | Boivie | 55/459 R X |
| 2,498,832 | 2/1950 | Watson et al. . | |
| 2,504,846 | 4/1950 | Kirby | 15/335 X |
| 2,523,614 | 9/1950 | Elverum | 55/459 R X |
| 2,542,634 | 2/1951 | Davis et al. | 55/429 X |
| 2,768,707 | 10/1956 | Campbell | 55/429 X |
| 2,790,554 | 4/1957 | Work . | |
| 2,824,335 | 2/1958 | Moffat | 15/353 X |
| 2,837,172 | 6/1958 | Klein et al. | 55/345 |
| 3,052,361 | 9/1962 | Whatley et al. . | |
| 3,210,061 | 10/1965 | Nogiwa . | |
| 3,210,127 | 10/1965 | Schaben et al. . | |
| 3,384,420 | 5/1968 | Fiscus . | |
| 3,533,506 | 10/1970 | Carr . | |
| 3,971,718 | 7/1976 | Reid . | |
| 4,200,415 | 4/1980 | Boring | 55/345 X |
| 4,204,849 | 5/1980 | Johnston | 55/345 X |
| 4,237,006 | 12/1980 | Colman et al. . | |
| 4,251,368 | 2/1981 | Colman et al. . | |

FOREIGN PATENT DOCUMENTS

| | | | |
|---|---|---|---|
| 1355017 | 2/1964 | France | 55/345 |
| 3955 | 3/1972 | Japan | 209/144 |
| 13225 | 4/1972 | Japan | 55/345 |

*Primary Examiner*—Kathleen J. Prunner

*Attorney, Agent, or Firm*—Ian C. McLeod

[57] ABSTRACT

A vacuum cleaning appliance comprises a lower efficiency cyclone unit and a high efficiency cyclone unit connected in series. This enables both large and fine dirt particles to be dealt with.

14 Claims, 3 Drawing Figures

VACUUM CLEANING APPLIANCE

This application is a continuation of application Ser. No. 452,917, filed 12/27/82, now abandoned, which in turn is a continuation of U.S. application Ser. No. 274,252, filed June 16, 1981, now abandoned.

DESCRIPTION

This invention relates to a vacuum suction cleaning appliance and in particular to a portable domestic appliance of the kind described in the published EPC Specification No. 0 018 197.

EPC Specification No. 0 018 197 describes an appliance in which a cleaner head for contacting a dirty surface is connected to the interior of the casing in which an airflow is set up by a motor driven fan. The casing contains two cyclone units in series operating successfully to extract dirt particles (dust and other extraneous matter) from the airflow therethrough and to deposit the extracted dirt.

A cleaning appliance based on cyclone units has the advantage that dust bags are not required as dirt can be discharged from the appliance by removing and separating the cyclones from the surrounding casing. Other advantages are that the air discharged from the appliance is substantially dust free and the use of filters as main cleaning elements is avoided.

In the appliance described in the said EPC patent application each of the two cyclone units has a body of substantially frusto-conical shape, this shape serving to maintain the velocity of the dirt particles swirling therein and hence render the cyclone capable of depositing fine dirt particles of small diameter. Such cyclone units with the means to maintain the velocity of the fine dirt particles will hereinafter be referred to as "high efficiency" cyclones.

This invention recognises that a vacuum cleaner incorporating only the higher efficiency cyclones necessary to deal with the fine particles does not operate entirely satisfactorily under normal domestic conditions when dirt particles of larger size and other extraneous objects are sucked into the appliance. These larger size particles tend to be retained either performing the spiral or circular motion in the cyclone or drifting to the cyclone central regions and are not deposited. This causes noise and interferes with the efficient operation of the cyclone.

Accordingly the present invention proposes incorporating into the air passage upstream, relatively to the inlet for dirty air, of the high efficiency cyclone unit a cyclone deliberately constructed to be of lower efficiency.

The present invention relates to a vacuum cleaning appliance including a cyclone unit and means for generating an airflow from a dirty air inlet through the said cyclone unit the cyclone unit being of a high efficiency having the capability of depositing fine dust particles and the appliance being characterized by a lower efficiency cyclone unit in the air path upstream of the high efficiency unit. The present invention further relates to a vacuum cleaning appliance comprising a casing with a dirty air inlet at one end, a generally cylindrical body constituting the lower efficiency cyclone unit positioned within the casing and being connected to the dirty air inlet, the high efficiency cyclone having a frusto-conical body part and being positioned within the lower efficiency cyclone unit, air being caused to flow from the low to the high efficiency cyclone unit.

This "lower efficiency" cyclone though not ultimately capable of dealing effectively with the finest particles, i.e., particles of 50 microns diameter or under, carries out a primary cleaning action of the dirty air flow by depositing all but some of these finer particles. The high efficiency cyclone is then left to function in its optimum conditions with comparatively clean air and only particles of very small size.

The lower efficiency can be contrived by omitting the frusto-conical formation and constructing for example the cyclone casing of cylindrical form with the normal tangential or scroll type air inlet adjacent one end.

Thus in a convenient and preferred configuration a vacuum cleaner casing comprises a generally cylindrical "low efficiency" cyclone with an inlet for dirty air and concentrically within the low efficiency cyclone a "high efficiency" cyclone, a passageway being provided to allow air from the low efficiency cyclone to enter an end part of the high efficiency cyclone. Clean air can then be withdrawn centrally from the high efficiency cyclone and exhausted if necessary through a final filter.

A particular embodiment of the invention will now be described by way of example and with reference to the accompanying drawings wherein.

GENERAL DESCRIPTION

Figure 1:
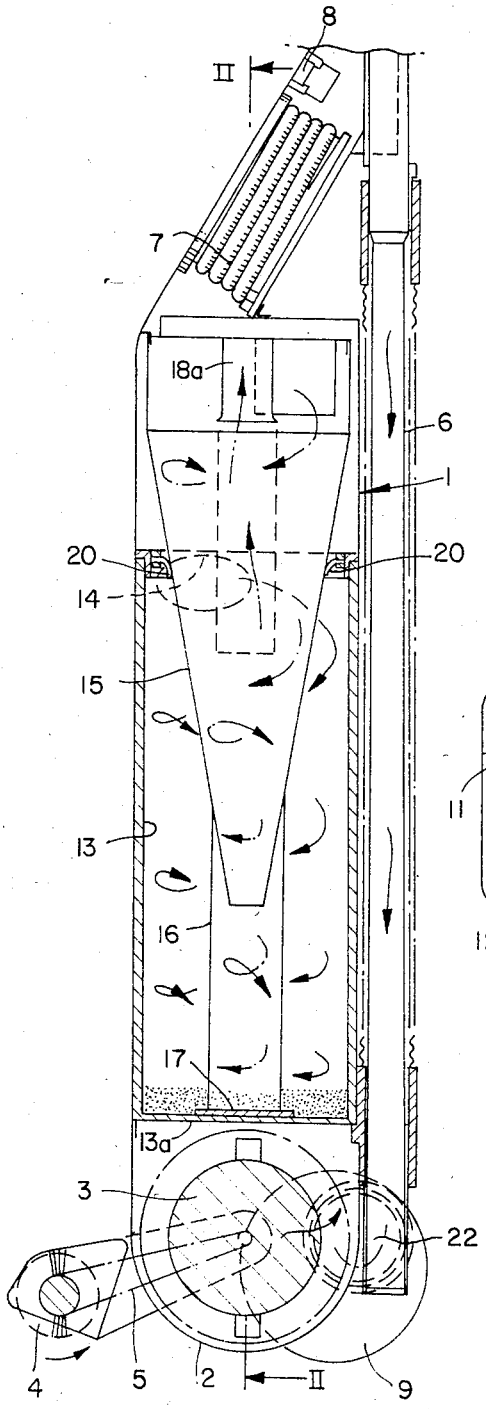
FIG. 1 is a side sectional view taken along the line I—I of FIG. 2.

The present invention relates to portable vacuum cleaning appliance comprising:

(a) an outer cyclone comprising a bottom (13*a*) and a substantially cylindrical casing (13) extending to and meeting said bottom, said casing defining a substantially cylindrical interior surface which acts as a substantially constant cross-sectional dirt rotation surface for said outer cyclone throughout its length, a dirty air inlet (14) at an upper portion of the casing spaced from the bottom and oriented to supply dirt laden air tangentially to the interior surface, and an outer cyclone air outlet communicating with the interior of the outer cyclone;

(b) an inner cyclone inside the outer cyclone having an upper end and a lower end smaller than the upper end and comprising an air inlet (18) oriented to supply air tangentially thereto and disposed at the upper end thereof in air communication through a passage (19) with the air outlet of the outer cyclone, the inner cyclone being of frusto-conical shape for maintaining the velocity of the air flow, and an inner cyclone air outlet communicating with the interior of the inner cyclone, the inner cyclone being separated from air flow connection with the outer cyclone except for the air inlet to the inner cyclone;

(c) a vacuum cleaner casing (1) supporting the outer cyclone and mounted on wheels (9);

(d) a floor contacting cleaning head (2) mounted on the vacuum cleaner casing including a brushing member (4) extending transversely of the head driven by a belt (5) attached to a shaft of a motor mounted on the vacuum cleaner casing adjacent the head;

(e) a handle (6) mounted on the vacuum cleaner casing for moving the appliance across the floor;

(f) an air entry means (11) providing an air flow path from the cleaning head adjacent the floor to the dirty air inlet at the upper portion of the outer cyclone;

(g) an air exit means (21) providing a clean air flow path from the inner cyclone air outlet to the vacuum cleaner casing adjacent the cleaning head; and (h) fan means (3) driven by the motor for generating an air flow connected to the air exit means, wherein the air passes through the cleaning head, the air entry means, the dirty air inlet, the outer cyclone, the outer cyclone air outlet, the passage, the inner cyclone and the inner cyclone air outlet, the air exit means, the air flow rotating around the interior surface of the outer cyclone, the exterior of the inner cyclone and the interior of the inner cyclone, the outer cyclone being of lower efficiency in removing small particles of dirt from dirt laden air than the inner cyclone.

SPECIFIC DESCRIPTION

The cleaning appliance illustrated comprises a main casing 1 adapted for use both in the vertical mode and the horizontal mode, the vertical mode being illustrated. The functioning of the appliance will be described with reference to this vertical mode. At the lower end part of the casing a cleaning head 2 is provided, the head 2 comprising a motor driven fan unit 3 and an elongate transversely extending brushing member 4 connected to the shaft of the motor by a belt 5. A pipe 6 stands upright along the back of the casing 1 and serves as a handle or for a connection to other suction tools. Extending between pipe 6 and to the upper end part of the casing is a holder for electric cable 7 and an on/off switch 8 for the appliance. The electrical arrangements for the cleaning appliance form no part of the present invention and will not be described. The appliance in the upright mode runs on wheels 9.

Figure 3:
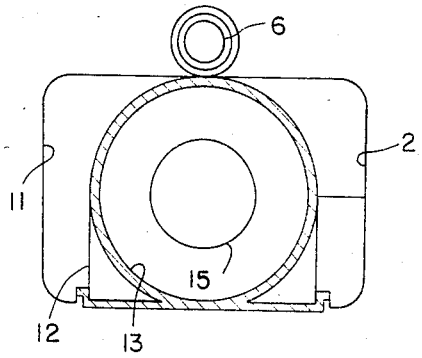
FIG. 3 is a section looking upwardly along the line III—III of FIG. 2.
Figure 2:
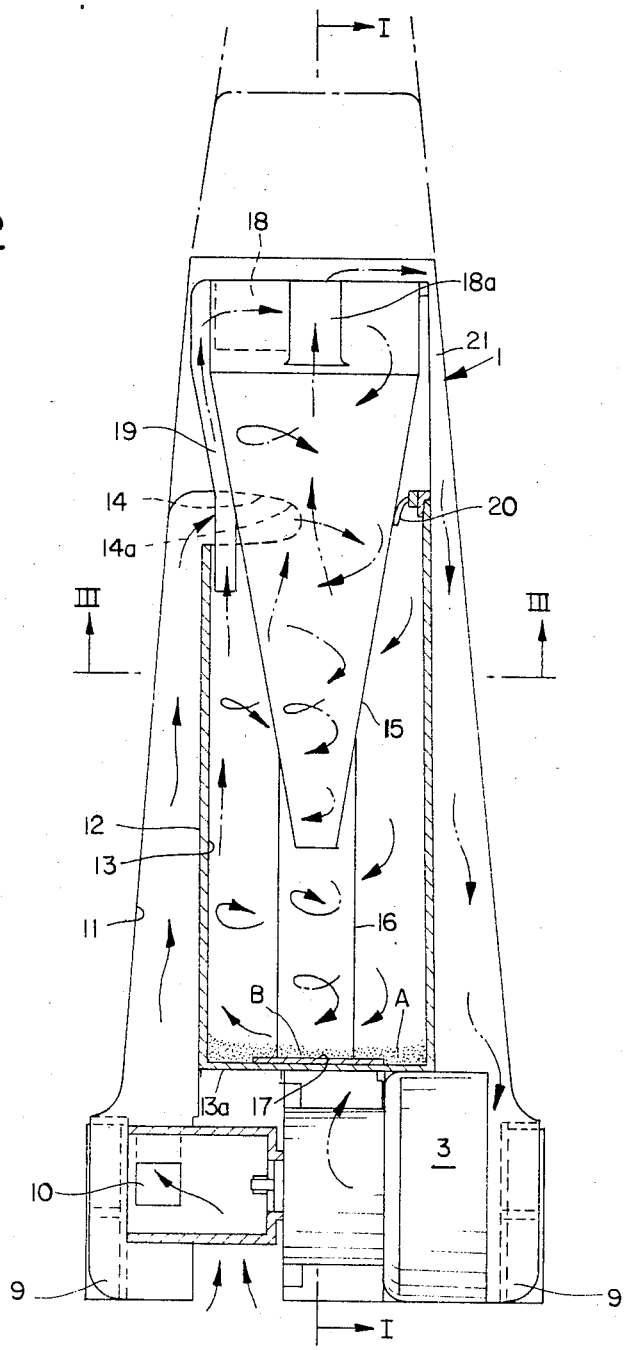
FIG. 2 is a front sectional view taken along the line II—II of FIG. 1.

Dirty air entering the appliance from behind brushes 4 communicates as can best be seen in FIG. 2 through a square port 10 with an entry passage 11 for dirty air defined by a partcircular sleeve 12 within the casing (see FIG. 3). Centrally and coaxially within the casing 1 and slidably fitted in sleeve 12 is the cylindrical casing 13 of the first low efficiency cyclone unit. The upper end of the dirty air entrance passage 11 communicates through part 14 providing an inlet 14*a* to casing 13 with the upper part of casing 13 so as to make a tangential entry and to set up a swirling cyclonic flow of air.

The high efficiency cyclone unit comprises a frusto-conical body portion 15 and a dependent cylindrical portion 16, the lower end part of which abuts against a support plate 17 on the base or bottom 13*a* of the low efficiency cyclone casing 13. Outside of the frusto-conical part and extending to a tangential entry port 18 is an entry pipe 19 to the high efficiency cyclone from the interior of the lower efficiency cyclone. The high efficiency cyclone unit is removable upwardly from the low efficiency cyclone unit and flexible bearing seals 20 are provided between the units. The upper end of the high efficiency cyclone communicates with a passage 21 leading from inner cyclone outlet pipe or passage 18*a* at the side of the cleaner opposite to the dirty air entry passage and defined between sleeve 12 and the cleaner outer casing. The lower end part of this passage communicates through the motor fan to exhaust.

The operation of the appliance will now be described with reference to the air flow designated by arrows differently marked to show the successive progress of the dirty air through the interior of the casing and the two cyclone units. →represents dirty air, →air cleaned by the low efficiency cyclone, →air cleaned by the high efficiency cyclone, and →finally discharged air. In operation of the device with the rotating brush 4 and the suction developed by the motor fan 3, dirty air carrying dust and other particles is drawn into the dirty air entry passage 11. The airstream carrying the dirt particles makes a tangential entry through port 14 into the upper part of the low efficiency cyclone casing 13 and performs cyclonic swirling movement generally along the line of the arrows and thereby deposits the majority of the dust particles in the lower part of the low efficiency cyclone as indicated at A. The airstream carrying only the finer particles then rises under the influence of the general airflow developed by the fan through pipe 19 and entry port 18 to a tangential entry to the high efficiency cyclone unit where the cyclonic cleaning process is repeated only with higher efficiency and greater particle velocity thereby contriving the deposit of the finer particles at B. The ultimately clean air rises under the influence of the air flow to the upper part of the high efficiency cyclone and returns through the clean air exit passage 21 to the motor fan and exhaust possibly with a final filter.

For discharge of particles the lower and high efficiency cyclone casings are removed upwardly and disengaged from one another. It will be appreciated that when the high efficiency cyclone casing is lifted from its seating on the base of the low efficiency cyclone casing 13 the contents thereof will be deposited so that the cylindrical body holds all the deposited particles. If desired a disposable liner can be provided for the low efficiency cyclone casing.

Means not shown may be provided for manually throttling the entry or exit pipe to the high efficiency cyclone. If the size of the entry or exit orifice to the cyclone is reduced then suction pressure is reduced but separation efficiency is enhanced. For use in the horizontal mode a valve schematically indicated at 22 is provided which is rotatable to close airflow from the brushes and to open the air passage to the pipe 6.

I claim:

1. A portable vacuum cleaning appliance comprising:

(a) an outer cyclone comprising a bottom and a substantially cylindrical casing extending to and meeting said bottom, said casing defining a substantially cylindrical interior surface which acts as a substantially constant cross-sectional dirt rotation surface for said outer cyclone throughout its length, a dirty air inlet at an upper portion of the casing spaced from the bottom and oriented to supply dirt laden air tangentially to the interior surface, and an outer cyclone air inlet communicating with the interior of the outer cyclone;

(b) an inner cyclone inside the outer cyclone having an upper end and a lower end smaller than the upper end and comprising an air inlet oriented to supply air tangentially thereto and disposed at the upper end thereof in air communication through a passage with the air outlet of the outer cyclone, the inner cyclone being of frusto-conical shape for maintaining the velocity of the air flow, and an inner cyclone air outlet communicating with the interior of the inner cyclone, the inner cyclone being separated from air flow connection with the outer cyclone except for the air inlet to the inner cyclone;

(c) a vacuum cleaner casing supporting the outer cyclone and mounted on wheels;

(d) a floor contacting cleaning head mounted on the vacuum cleaner casing including a brushing member extending transversely of the head driven by a belt attached to a shaft of a motor mounted on the vacuum cleaner casing adjacent the head;

(e) a handle mounted on the vacuum cleaner casing for moving the appliance across the floor;

(f) an air entry means providing an air flow path from the cleaning head adjacent the floor to the dirty air inlet at the upper portion of the outer cyclone;

(g) an air exit means providing a clean air flow path from the inner cyclone air outlet to the vacuum cleaner casing adjacent the cleaning head; and (h) fan means driven by the motor for generating an air flow connected to the air exit means, wherein the air passes through the cleaning head, the air entry means, the dirty air inlet, the outer cyclone, the outer cyclone air outlet, the passage, the inner cyclone and the inner cyclone air outlet, the air exit means, the air flow rotating around the interior surface of the outer cyclone, the exterior of the inner cyclone and the interior of the inner cyclone, the outer cyclone being of lower efficiency in removing small particles of dirt from dirt laden air than the inner cyclone.

2. The appliance of claim 1 wherein the interior surface of the outer cyclone is cylindrical.

3. The vacuum cleaning appliance of claim 1, wherein the outer cyclone is supported on the vacuum cleaning casing between the dirty air inlet and the inner cyclone air outlet.

4. The vacuum cleaning appliance of claim 1 wherein the inner cyclone further comprises a generally circular cross-sectioned portion which extends to the bottom of the outer cyclone from the lower end of the inner cyclone and wherein the circular cross-sectioned portion collects dirt from the inner cyclone.

5. The vacuum cleaning appliance of claim 4, wherein the generally circular cross-sectioned portion surrounds the lower end of the inner cyclone so that a part of the inner cyclone projects into the circular cross-sectioned portion.

6. A portable vacuum cleaning appliance comprising:

(a) an outer cyclone comprising a bottom and a substantially cylindrical cyclone casing extending to and meeting said bottom, said casing defining a substantially cylindrical interior surface which acts as a substantially constant cross-sectional dirt rotation surface for said outer cyclone throughout its length, a dirty air inlet at an upper portion of the casing spaced from the bottom and oriented to supply dirt laden air tangentially to the interior surface, and an outer cyclone air outlet communicating with the interior of the outer cyclone;

(b) an inner cyclone disposed concentric with and inside said outer cyclone having an upper end and a lower end smaller than the upper end, said inner cyclone comprising an air inlet which oriented to supply air tangentially thereto and disposed at the upper end thereof in air communication through a passage with said air outlet of said outer cyclone, the inner cyclone being of frusto-conical shape for maintaining the velocity of the air flow, and an inner cyclone air outlet communicating with the interior of said inner cyclone, the inner cyclone being separated from air flow connection with the outer cyclone except for the air inlet to the inner cyclone;

(c) a vacuum cleaner casing supporting the outer cyclone and mounted on wheels;

(d) a floor contacting cleaning head mounted on the vacuum cleaner casing including a brushing member extending transversely of the head and drivey by a belt attached to a shaft of a motor mounted on the vacuum cleaner casing adjacent the head;

(e) a handle mounted on the vacuum cleaner casing for moving the appliance across the floor;

(f) an air entry means providing an air flow path from the cleaning head adjacent the floor to the dirty air inlet at the upper portion of the outer cyclone;

(g) an air exit means providing a clean air flow path from the inner cyclone air outlet to the vacuum cleaner casing adjacent the cleaning head; and (h) fan means driven by the motor for generating an air flow connected to the air exit means wherein the air passes sequentially through the cleaning head, the air entry means, and the dirty air inlet, the outer cyclone, the outer cyclone air outlet, the passage, the inner cyclone and the inner cyclone air outlet, the air exit means, the air flow rotating around the interior surface of the outer cyclone, the exterior of the inner cyclone and the interior of the inner cyclone, the outer cyclone being of lower efficiency in removing small particles of dirt from dirt laden air than the inner cyclone.

7. The appliance of claim 6 wherein the interior surface of the outer cyclone is cylindrical.

8. The vacuum cleaning appliance of claim 6, wherein the outer cyclone is supported on the casing between the air entry and the air exit means.

9. The vacuum cleaning appliance of claim 6 wherein the inner cyclone further comprises a generally circular cross-sectioned portion which extends to the bottom of the outer cyclone from the lower end of the inner cyclone and wherein the circular cross-sectioned portion collects dirt from the inner cyclone.

10. The vacuum cleaning appliance of claim 9, wherein the circular cross-sectioned portion surrounds the lower end of the inner cyclone so that a part of the inner cyclone projects into the circular cross-sectioned portion.

11. In a portable vacuum cleaning appliance for picking up dirt, the improvement which comprises:

(a) an outer cyclone comprising a bottom and a substantially cylindrical cyclone casing extending to and meeting said bottom, said cyclone casing defining a substantially cylindrical interior surface which acts as a substantially constant cross-sectional dirt rotation surface for said outer cyclone throughout its length and an upper portion spaced from the bottom, a first passage leading to a dirty air inlet provided at the upper portion of the cyclone casing leading into said casing and oriented to supply dirt laden air tangentially to and on the interior surface and an air outlet from the interior of the casing provided adjacent the upper portion of the cyclone casing;

(b) an inner cyclone having an upper end and a lower end smaller than the upper end disposed inside the outer cyclone and having a frusto-conical shape and with an opening at the lower end spaced from the bottom of the outer cyclone, the inner cyclone having an air inlet in communication through a second passage with the air outlet of the outer cyclone and oriented to supply air tangentially into the inner cyclone and an air outlet adjacent the upper end of the inner cyclone for outlet of clean air from the inner cyclone, the inner cyclone being separated from air flow connection with the outer cyclone except for the air inlet to the inner cyclone;

(c) a dependent portion positioned around the opening at the lower end of the inner cyclone and extending to the bottom of the outer cyclone for collecting dirt from the inner cyclone;

(d) fan means driven by a motor for generating an air flow mounted on the appliance which passes first through the first passage into the outer cyclone to remove larger dirt particles and then through the second passage to the inner cyclone to remove smaller dirt particles and then is removed as clean air; and (e) means for picking up dirt connected to the first passage.

12. The appliance of claim 11 wherein the inner and outer cyclones are concentric.

13. A filterless and bagless upright vacuum cleaner, comprising:

a vacuum cleaner casing;

wheels connected with said vacuum cleaner casing, and supporting said vacuum cleaner casing for rolling movement across a floor surface to be cleaned;

a cleaning head with a brushing member extending transversely across the head driven by a belt attached to a shaft of motor means mounted on the casing adjacent the head, said cleaning head being mounted on said vacuum cleaner casing, whereby said cleaning head is normally maintained in engagement with the floor surface to be cleaned, at least in its normal upright vacuum cleaning mode;

a handle connected with said vacuum cleaner casing to facilitate moving said vacuum cleaner casing over the floor surface;

a large particle depositing cyclone comprising a bottom and a substantially cylindrical casing extending to and meeting said bottom, said casing defining a cylindrical interior surface which acts as a substantially constant cross-sectional dirt rotation surface for said large particle depositing cyclone throughout its length, the cyclone casing having upper and lower ends,; the lower end of said large-particle cyclone casing having an imperforate bottom sealingly closing the same to define a first dust bin; the upper end of said large-particle cyclone casing having an inlet in communication through a passage with a cleaning head and oriented to direct a stream of dirt-laden air from the cleaning head tangentially against the interior surface of said large-particle cyclone casing, and downwardly toward the bottom thereof in a helical current, whereby relatively large-particles suspended in the dirt-laden air are forced radially outwardly against the interior surface of the large-particle cyclone casing under centrifugal forces, and are thence carried downwardly along the interior surface of the large-particle cyclone casing into the first dust bin as the air current travels along its helical course;

a small-particle depositing inner cyclone located inside said large particle depositing cyclone casing, and including a generally frustoconically-shaped body with upper and lower ends, and with the lower end having a diameter smaller than the upper end and defining an open end; said small-particle depositing inner cyclone being oriented with the lower end directed downwardly; the lower end of said small-particle depositing inner cyclone having a dependent portion sealingly closing the same to define a second dust bin; the upper end of said small-particle depositing inner cyclone having an inlet oriented to direct a stream of partially cleaned air from said large-particle depositing cyclone casing tangentially into said small-particle depositing inner cyclone, and downwardly toward the dependent portion thereof in a spiralling, cyclone current, whereby relatively small-particles suspended in the partially cleaned air stream are forced radially outwardly against said small-particle depositing inner cyclone under centrifugal forces, and are carried downwardly into the second dust bin as the air stream travels along its spiralling, cyclonic course;

said large particle depositing cyclone casing and small-particle depositing inner cyclone each having an outlet disposed downstream of the respective inlet;

a passage operatively communicating the outlet of said large-particle depositing cyclone casing with the inlet of said small-particle depositing inner cyclone;

fan means in communication with said outlet of said small particle depositing cyclone and mounted on the shaft of motor means for creating a vacuum in the passage communication with said cleaning head, and flowing air into and through said large-particle depositing cyclone casing and small-particle depositing inner cyclone and the outlet of the inner cyclone, whereby both large and small dirt-particles are sequentially substantially removed from the dirt-laden air by virtue of the cyclonic cleaning action of said large-particle depositing cyclone casing and small-particle depositing inner cyclone, without any bags.

14. An upright vacuum cleaner as set forth in claim 13, wherein:

said small-particle depositing inner cyclone is positioned concentric with, and partially within said large-particle depositing cyclone casing.

* * * * *

UNITED STATES PATENT AND TRADEMARK OFFICE

CERTIFICATE OF CORRECTION

PATENT NO. : 4,593,429

DATED : June 10, 1986

INVENTOR(S) : James Dyson

It is certified that error appears in the above-identified patent and that said Letters Patent is hereby corrected as shown below:

Column 2, line 38, "relates to portable" should read -- relates to a portable --.

Column 4, line 24, "exit" should be deleted.

Column 4, line 54, "inlet" should read -- outlet --.

Column 5, line 30, "cleaning" should read -- cleaner --.

Column 5, line 59, delete "which".

Column 6, line 5, "drivey" should read -- driven --.

Column 8, line 39, "communication" should read -- communicating --.

Signed and Sealed this

Thirteenth Day of October, 1987

*Attest:*

DONALD J. QUIGG

*Attesting Officer*

*Commissioner of Patents and Trademarks*